US011353216B2

(12) United States Patent
Chirumbolo

(10) Patent No.: US 11,353,216 B2
(45) Date of Patent: Jun. 7, 2022

(54) SWITCH ASSEMBLY

(71) Applicant: ILLINOIS TOOL WORKS INC., Glenview, IL (US)

(72) Inventor: Dino Chirumbolo, Barasso (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/125,419

(22) Filed: Dec. 17, 2020

(65) Prior Publication Data

US 2021/0180794 A1 Jun. 17, 2021

(30) Foreign Application Priority Data

Dec. 17, 2019 (EP) ..... 19217227
Oct. 23, 2020 (EP) ..... 20203643

(51) Int. Cl.
*F24C 3/10* (2006.01)
*F24C 3/02* (2021.01)
*F24C 3/08* (2006.01)
*F24C 3/12* (2006.01)

(52) U.S. Cl.
CPC ..... *F24C 3/103* (2013.01); *F24C 3/025* (2013.01); *F24C 3/082* (2013.01); *F24C 3/122* (2013.01)

(58) Field of Classification Search
CPC ..... F24C 3/103; F24C 3/025; F24C 3/082; F24C 3/112; F24C 3/122
USPC ..... 126/25 B, 39 BA, 39 N, 52; 431/256–257
See application file for complete search history.

(56) References Cited

U.S. PATENT DOCUMENTS 7,902,476 B2 * 3/2011 Querejeta Andueza ..... H01H 3/0206 200/569

OTHER PUBLICATIONS

European Patent Office (EPO), Form 1507N, Communication, dated Jun. 18, 2020 (1 page).

(Continued)

*Primary Examiner* — Vivek K Shirsat
(74) *Attorney, Agent, or Firm* — Pauley Erickson & Swanson

(57) ABSTRACT

A switch assembly for controlling the ignition of gas burners of a cooking appliance having one or more gas valves. The switch assembly includes at least one first support member, operably couplable to a first gas valve, a spring biased ignition switch operably mountable to the at least one first support member, and an actuating member, having a longitudinal axis and operably couplable to at least the first gas valve between the at least one first support member and at least a control knob of at least the first gas valve. The actuating member is adapted to move between a first position, actuatingly engaged with the ignition switch, and a second position, actuatingly disengaged from the ignition switch, wherein the actuating member is moved towards the first position by at least the control knob, and back towards the second position by the spring biased ignition switch.

14 Claims, 10 Drawing Sheets

(56) References Cited

OTHER PUBLICATIONS

European Patent Office (EPO), Form 1503 03.82, European Search Report, dated Jun. 9, 2020 (1 page).
European Patent Office (EPO), Form P0461, Annex to the European Search Report on European Patent Application 19 21 7227, dated Jun. 9, 2020 (1 page).
European Patent Office (EPO), Form 1703 01.91TRI, European Search Opinion, dated Jun. 9, 2020 (3 pages).
European Patent Office (EPO), Form P04A42, Info Sheet, dated Jun. 9, 2020 (1 Page).

* cited by examiner

SWITCH ASSEMBLY

CROSS REFERENCE TO RELATED APPLICATION

European Patent Application No. EP 19217227.8, filed 17 Dec. 2019 and European Patent Application No. EP 20203643.0, filed 23 Oct. 2020, the priority documents corresponding to this invention, to which a foreign priority benefit is claimed under Title 35, United States Code, Section 119, and their entire teachings are incorporated, by reference, into this specification.

BACKGROUND OF THE INVENTION

Field of the Invention

The present invention relates to a switch assembly for controlling the ignition of gas burners of a cooking appliance having one or more gas valves in general and, in particular, for use in domestic cooking appliances provided with a plurality of gas burners controlled by respective gas valves.

Description of Prior Art

Domestic cooking appliances for kitchens, generally known as "cooktops", may comprise a plurality of gas burners associated with respective gas valves which allow the user to ignite the flame and adjust the flame intensity. Generally, gas burners are associated with respective spark plugs to ignite the flow of combustible gas. The spark plugs are electrically connected to an electric igniter which supplies respective spark plugs with a high voltage current designed to generate the spark discharge on the spark plugs. The electric igniter is in turn controlled by a plurality of switches, each of which is associated with a respective gas valve. The switches are actuated when the respective gas valve is opened. The actuation of any one of the switches associated with one of the gas valves closes the igniter power supply circuit and produces the spark discharge on the respective spark plug.

However, one of the drawbacks of the solutions provided by the prior art is that an electric switch is required for each one of gas valves to produce the spark discharge. Furthermore, the positioning of each electric switch at the corresponding valve may compromise the water spillage test result (fluid seal) and may also obstruct access to the valve, e.g. for installation to cooking appliance or for maintenance.

In addition, the cooking appliances generally require switches of a specific type depending on whether the spark plug ignition control occurs with a rotary movement (i.e. turning) or with an axial movement (i.e. pushing) of the knob.

An example embodiment of a known switch assembly 10 is shown in FIG. 1. Such a switch assembly is usually installed to a typical cooking appliance, the cooking appliance having a plurality of gas valves arranged in series and coupled to a gas supply pipe (not shown). The switch assembly 10 has multiple ignition switches 14, each one couplable to a gas valve and electrically connected via cabling 12 to connectors 16. The connectors 16 provide electrical connection to an igniter power supply circuit in order to produce spark discharges to ignite the respective gas burner. Each one of the ignition switches 14 has a head section 15 mounted to and engaged with the gas valve such that opening of its gas supply actuates the head section 15 which then closes the respective switch 14, thereby producing the spark discharge.

In this particular embodiment of the switch assembly 10, there are a number of variables to consider, in order that it may be adapted to the many commercially available cooking appliances including the lengths of the sections of cabling, the configuration of the head section 15, and the number of ignition switches. The sequential arrangement of ignition switches necessitates numerous electrical connections, and the way that the head section engages with the gas valve may also require anti-flooding gaskets to be used. Taking account of all of these factors requires a large number of different switch assemblies in order to supply an assembly suitable for all cooking appliances.

SUMMARY OF THE INVENTION

According to a first aspect of the invention, there is provided a switch assembly for controlling the ignition of gas burners of a cooking appliance having one or more gas valves, comprising:

at least one first support member, operably couplable to a first gas valve;

a spring biased ignition switch, operably mountable to the at least one first support member;

an actuating member, having a longitudinal axis and operably couplable to at least the first gas valve between the at least one first support member and at least a control knob of at least the first gas valve, adapted to move between a first position, actuatingly engaged with the ignition switch, and a second position, actuatingly disengaged from the ignition switch, wherein the actuating member is moved towards the first position by at least the control knob, and back towards the second position by the spring biased ignition switch.

Advantageously, the switch assembly may be adapted so that, when the cooking appliance has a plurality of serially arranged gas valves, the actuating member is operably couplable to all of the plurality of gas valves along the longitudinal axis.

In this way, the switch assembly requires only one ignition switch for the whole assembly and, consequently, a whole cooking appliance. This results in a simpler assembly made up from significantly fewer parts, subsequently saving assembly time. Knock on benefits from reduced amounts of packaging and electric cabling may also be provided.

Further, the positional mounting of the ignition switch that is away from the gas valve axle or the stem may allow for the switch to be located in a position where it is protected against ingress of contamination from liquid, detergent or food.

Yet further, by providing flexibility on which gas valve the switch of the switch assembly may be coupled to, the invention provides the installer with freedom to adopt any configuration for the switch assembly, which allows optimization of the connection wiring to any cooking appliance.

Also, the present invention provides for improved accessibility to the gas valves even once the switch assembly is installed in a cooking appliance.

Advantageously, the actuating member may include a plurality of apertures equidistantly spaced apart along the longitudinal axis, each one configured to operably engage with a respective one of the plurality of gas valves, during use.

Advantageously, the switch assembly may be adapted so that at least one of the plurality of apertures is configured to provide for a predetermined range of variation for distances between the plurality of serially arranged gas valves.

In this way, a single actuating member may be suitable for fitting to different cooking appliances with varying gas valves and gas valve spacings. A standardized actuating member may thus be provided in order to fit to a higher quantity of gas valve interaxle spacing, as might be provided by different models of cooking appliances. Further, the same actuating member may be used for cooking appliances with different numbers of gas valves and burners.

Advantageously, the actuating member may be movable towards the first position at least by the control knob of any one of the plurality of serially arranged gas valves.

In this way, the user can close the ignition circuit and ignite a burner by operating any one of the cooking appliance's control knobs. Once the burner is ignited, the ignition circuit is open until the user chooses to light a second burner. This second burner is then ignited using the same ignition circuit as the first.

Advantageously, the at least one first support member may comprise a switch bracket configured to mountingly receive the spring biased ignition switch.

Advantageously, the switch assembly may include at least one second support member operably couplable to a second gas valve.

In this way, the actuating member can be oriented and actuated more accurately with respect to the ignition.

Advantageously, the actuating member may be movably coupled to the first and second support member.

Advantageously, each one of the first and second support member may be adapted to slidingly retain a respective end portion of the actuating member.

In one embodiment, the actuating member may be pivotably coupled to at least the first support member and is configured to rotatably move between the first position and the second position about a pivot axis that is parallel to the longitudinal axis.

In this way, the actuating member may be moved towards the first position by the user axially pushing down the control knob of any gas valve.

Advantageously, the actuating member may be pivotably coupled to the first support member and the second support member.

In another embodiment, the actuating member may be operably couplable to at least the first gas valve via a cam mechanism adapted to convert a rotationally translational movement of the control knob of at least the first gas vale into a linear movement of the actuating member between the first position and the second position along the longitudinal axis.

In this way, the actuating member may be moved towards the first position by the user simply rotating the control knob of any gas valve about its center axis.

Advantageously, the cam mechanism may be adapted to operably engage with at least a first one of the plurality of apertures at a predetermined minimum angle of rotation and translation of the control knob.

Advantageously, a cooking appliance may be provided comprising a switch assembly according to the first aspect of the invention.

BRIEF DESCRIPTION OF SEVERAL VIEWS OF THE DRAWINGS

Embodiments of the invention are now described, by way of example only, hereinafter with reference to the accompanying drawings, in which.

In the drawings, like reference numerals refer to like parts.

DESCRIPTION OF PREFERRED EMBODIMENTS

Figure 1:
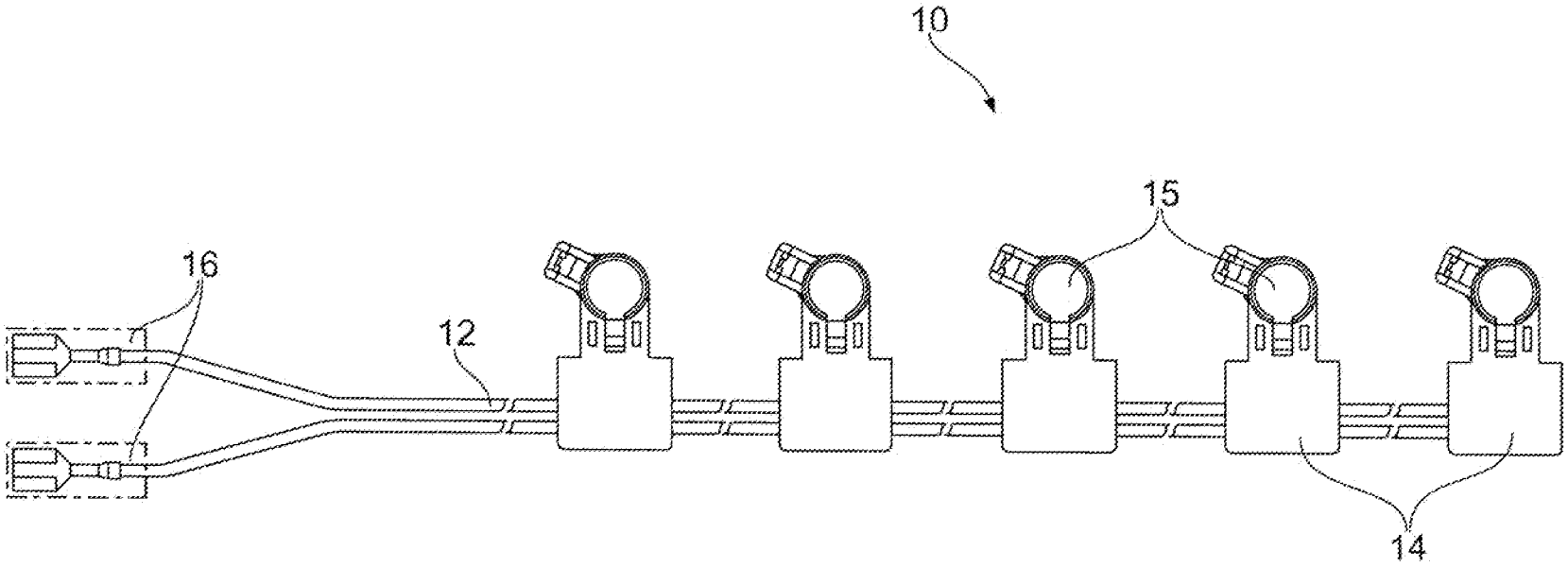
FIG. 1 (Prior Art)
FIG. 1 shows an illustration of a known switch assembly for a cooking appliance.

The described example embodiment relates to a cooking appliance, and in particular to a switch assembly for the ignition of a gas cooking appliance having one or more gas valves.

Certain terminology is used in the following description for convenience only and is not limiting. The words 'upper' and 'lower' and designate directions in the drawings to which reference is made and are with respect to the described component when assembled and mounted. The words 'inner', 'inwardly' and 'outer', 'outwardly' refer to directions toward and away from, respectively, a designated centerline or a geometric center of an element being described (e.g. central axis), the particular meaning being readily apparent from the context of the description.

Further, as used herein, the terms 'connected', 'attached', 'coupled', 'mounted' are intended to include direct connections between two members without any other members interposed therebetween, as well as, indirect connections between members in which one or more other members are interposed therebetween. The terminology includes the words specifically mentioned above, derivatives thereof, and words of similar import.

Further, unless otherwise specified, the use of ordinal adjectives, such as, 'first', 'second', 'third' etc. merely indicate that different instances of like objects are being referred to and are not intended to imply that the objects so described must be in a given sequence, either temporally, spatially, in ranking or in any other manner. Like reference numerals are used to depict like features throughout.

Referring now to FIGS. 2 to 8, a first embodiment of the switch assembly 100 of the present invention is shown. The switch assembly 100 is mounted to and operably engaged with a series of gas valves 114, requiring considerable fewer component parts than a known assembly (such as the known switch assembly 10). The component parts of the switch assembly 100 are also adaptable to different cooking appliances, irrespective of design and configuration, as will be explained below.

Figure 2A:
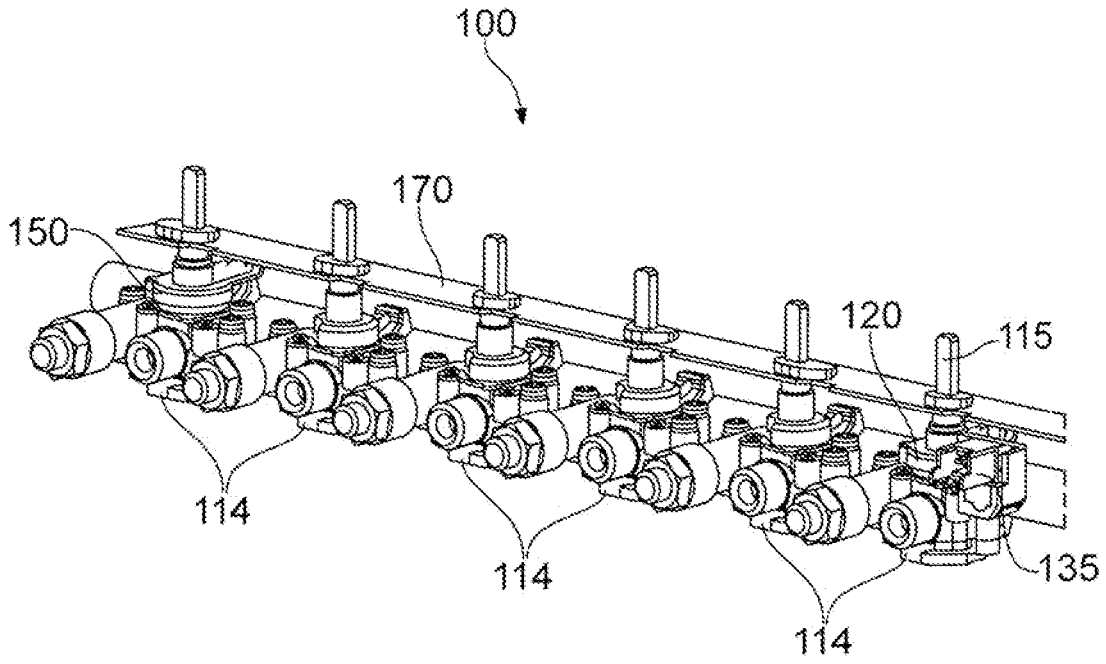
FIG. 2A shows a perspective view of the switch assembly of the present invention when mounted to a cooking appliance having a plurality of serially arranged gas valves.
Figure 2B:
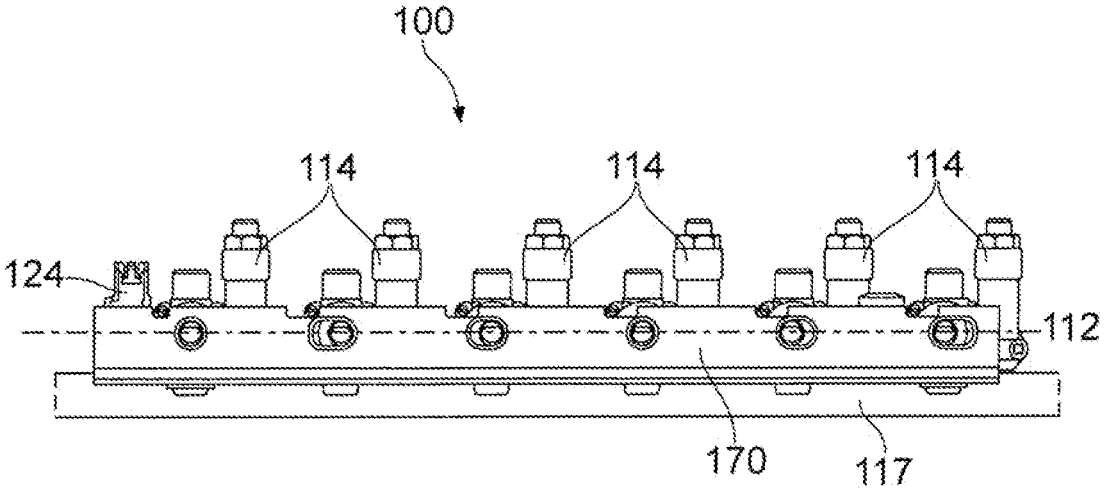
FIG. 2B shows a top view of the switch assembly of the present invention when mounted to a cooking appliance having a plurality of serially arranged gas valves.

As shown in FIG. 2, the switch assembly 100 includes, inter alia, an actuating member 170, a first support member 120, a second support member 150 and an electric ignition switch 135. The actuating member 170 is pivotably coupled to both first and second support members 120, 150. The two support members 120, 150 are each mounted to one of the plurality of serially arranged gas valves 114.

In this particular example, the gas valves 114 make up a linear series, arranged along axis 112, which is parallel to the longitudinal axis of the gas supply pipe 117. In this example, the actuating member 170 is configured to span and engage all the gas valves 114 so that the single ignition switch 135 is actuated by operating any one of the serially arranged gas valves 114.

Figure 3:
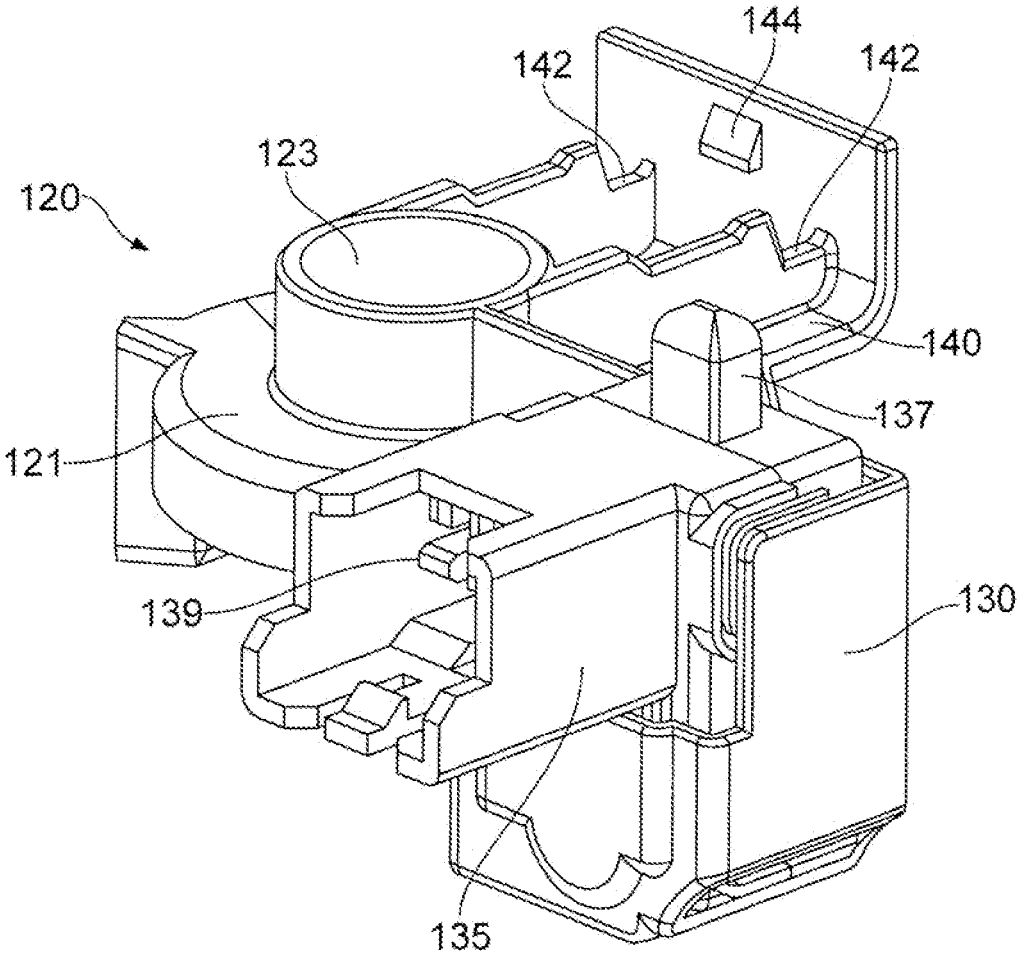
FIG. 3 shows a perspective view of a first support member according to the present invention.

FIG. 3 shows the first support member 120 in more detail, which includes a switch bracket 130, a first mounting portion 121 and a first support arm 140. The first mounting portion 121 has a cylindrical aperture 123 sized so as to fit over the stem 115 of a gas valve 114 when coupled to the gas valve 114.

The first support arm 140 extends away from the rear side of the first support member 120 and is provided with a clip mechanism comprising a pair of first receiving elements 142 and a first locking element 144. Together, the first receiving elements 142 and first locking element 144 are configured to removably engage with the actuating member 170.

The switch bracket 130 extends away from the first mounting portion 121 and the first support arm 140 and is adapted to mountingly receive the electric ignition switch 135. In this position, the electric ignition switch 135 is positioned away from the gas valve 114 therefore minimizing the risk of contamination, e.g. in case substances such as food, liquid or detergent get into the cooking appliance by bypassing the gas valve control knob 119 (see FIG. 8).

Figure 9:
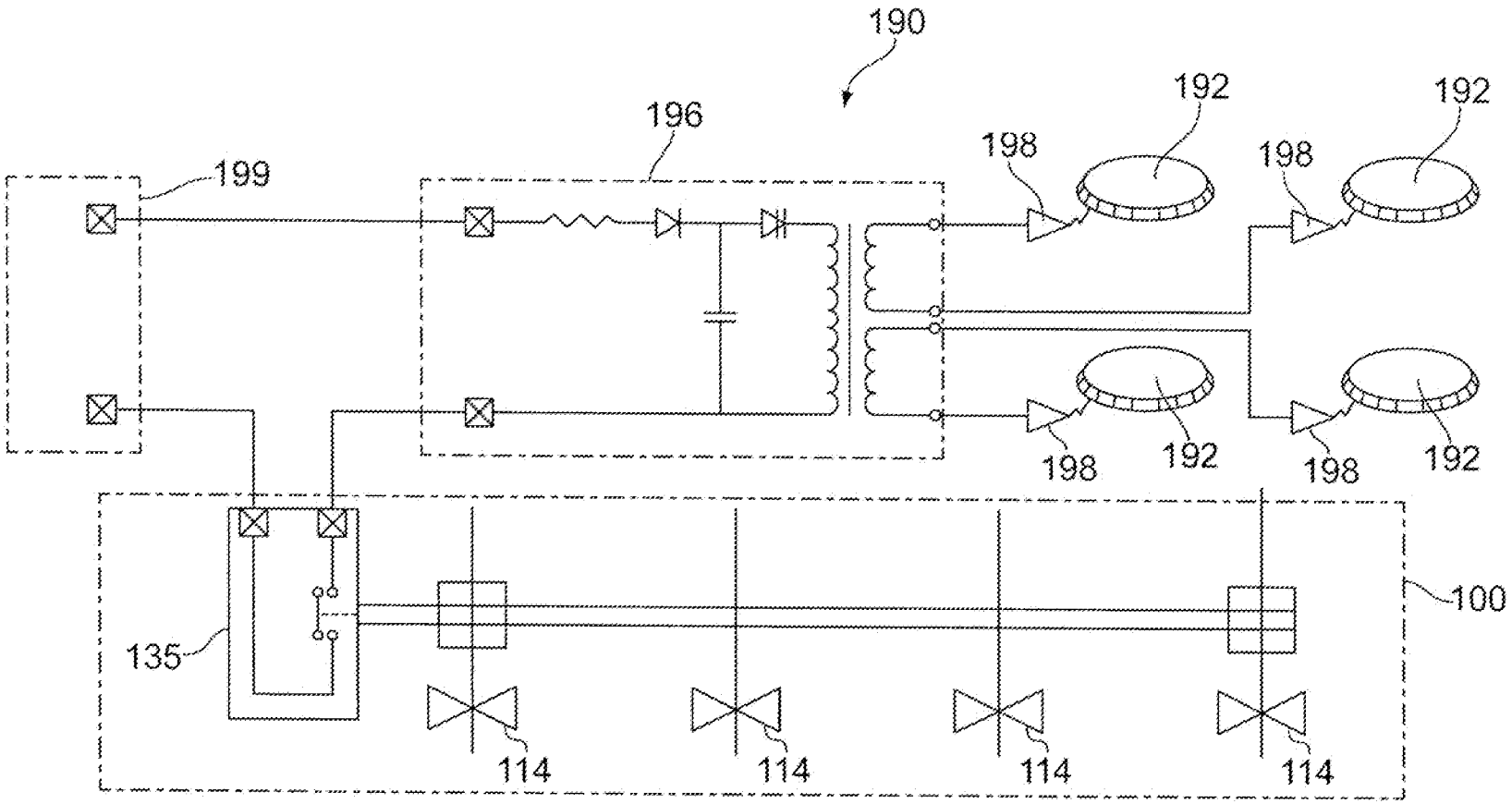
FIG. 9 shows a schematic diagram illustrating a cooking appliance provided with a switch assembly according to the present invention.

The electric ignition switch 135 may be a standard ignition switch having a spring biased actuator 137 and fixed electrical contacts 139, which enable the electric ignition switch 135 to be electrically connected to the terminal board 199 (see FIG. 9). In a first position, the actuator 137 is biased into an extended position such that the power supply circuit of the electric igniter circuit 196 is open (i.e. the switch is OFF). The actuator 137 can be pushed into a second position, where the power supply circuit of the electric igniter 196 is closed (i.e. the switch is ON), enabling the spark plugs 198 to discharge.

Figure 4:
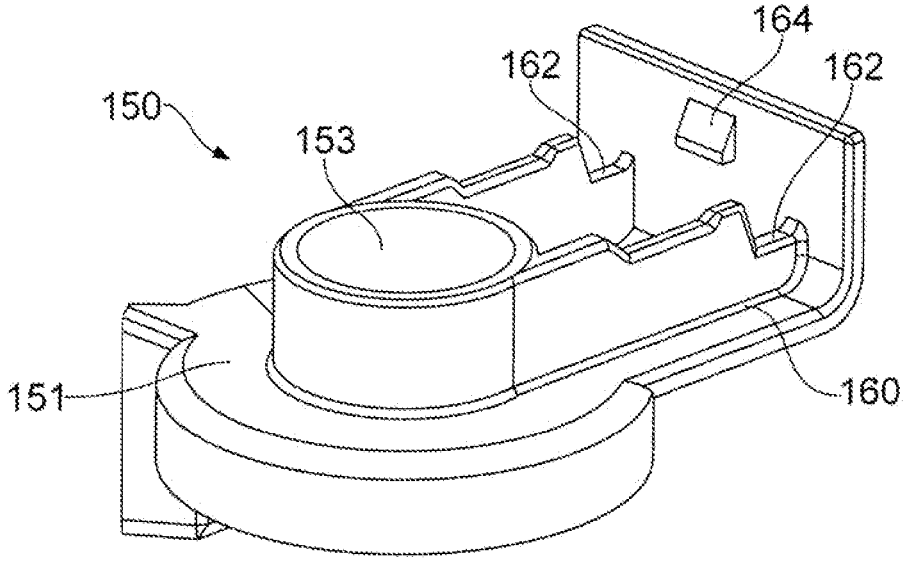
FIG. 4 shows a perspective view of a second support member according to the present invention.

FIG. 4 shows an illustration of the second support member 150, including a second mounting portion 151 and a second support arm 160. The second mounting portion 151 of the second support member 150 has a cylindrical aperture 153 sized so as to locate and thereby couple the second support member 150 to one of the gas valves 114 (e.g. to stem 115). The second support arm 160 is provided towards the rear of the second support member 150, including the same clip mechanism as the first support member 120, i.e. a second locking element 164 and a pair of second receiving elements 162. The clip mechanism is configured to removably engage with the actuating member 170 in the same manner as the clip mechanism of the first support member 120.

Figure 5:
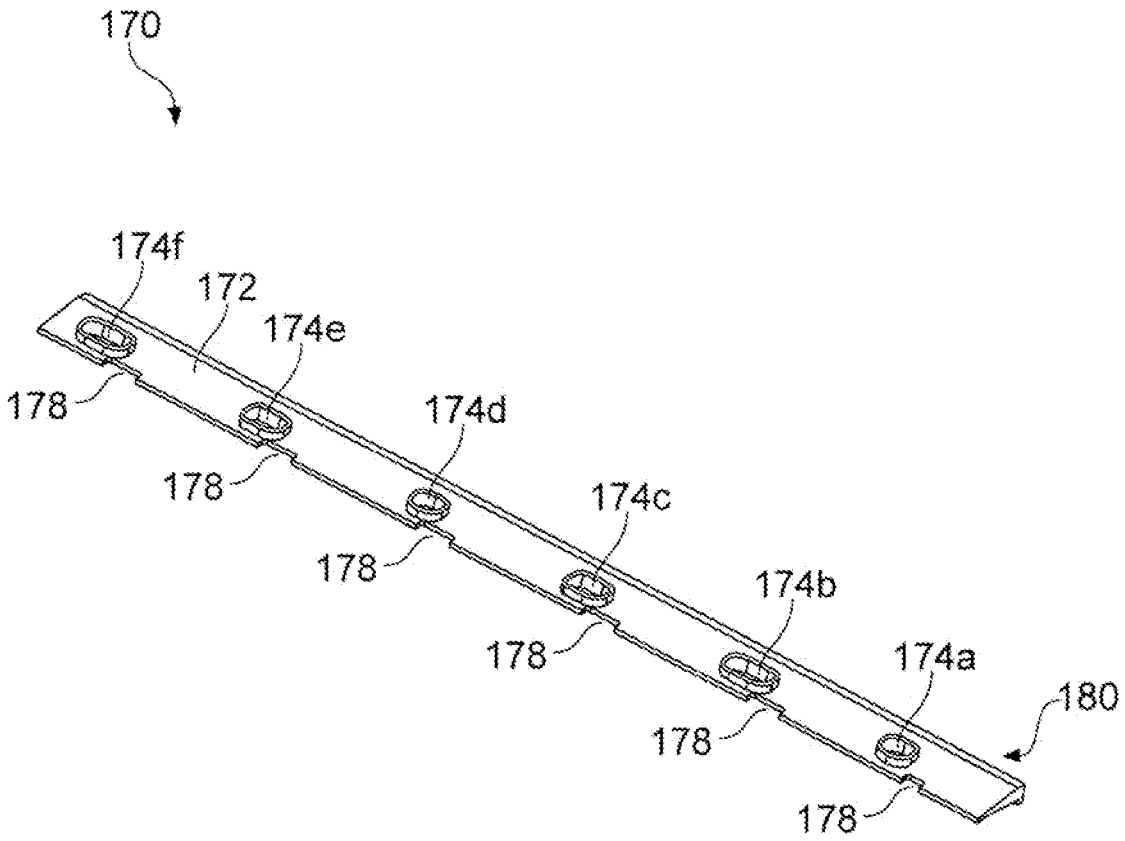
FIG. 5 shows a perspective view of an actuating member according to the present invention.

FIG. 5 shows an illustration of the actuating member 170 of this example embodiment which is made of a substantially rectangular plate 172 having a longitudinal axis 173. The actuating member 170 has a flange 180 projecting from the long distal edge of the plate 172, and a series of apertures 174*a-f* through its principle surface. The apertures 174*a-f* may be spaced apart equidistantly along the longitudinal axis 173 of the rectangular plate 172. Any one of the apertures 174*a-f* may be of different size and/or shape (e.g. circular or oval), so as to provide for variable spacing between the plurality of gas valves 114.

Figure 6:
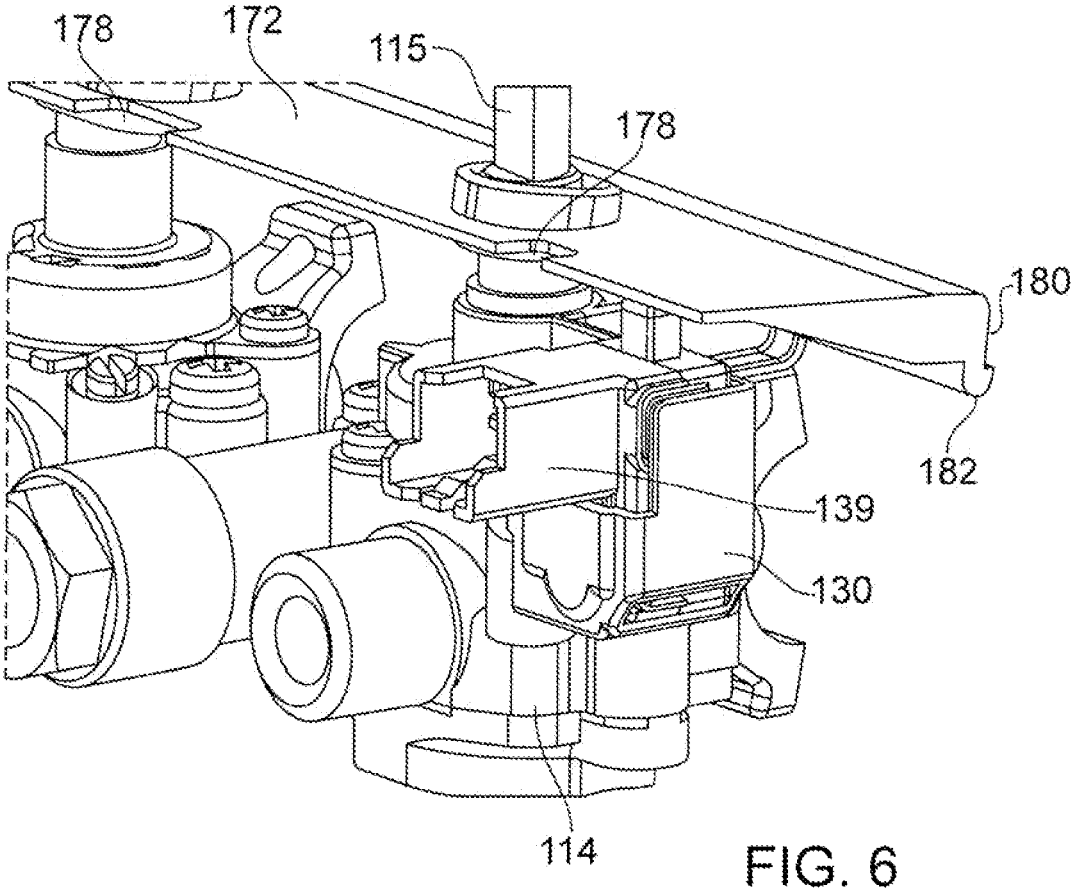
FIG. 6 shows a perspective view of the actuating member coupled to the first support member that is mounted to a gas valve of a cooking appliance.
Figure 7:
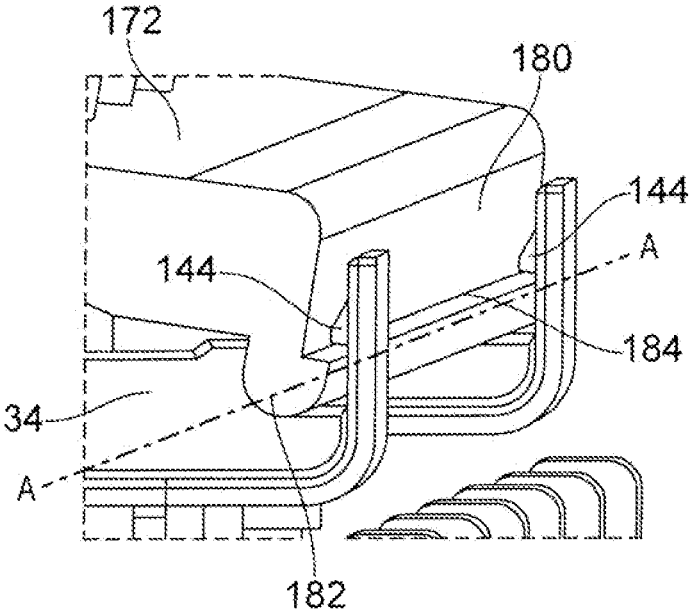
FIG. 7 shows a rear perspective view of the switch assembly.

As shown more clearly in FIGS. 6 and 7, the projecting flange 180 extends away from the plate 172 in a direction that is substantially perpendicular to the upper surface of the plate 172, ending at a rounded rib 182. Further, the flange 180 has a step portion 184 towards the rear of the plate 172 that is configured to operably engage with the clip mechanism of respective first and second support arm 140, 160. During use, the plate 172 is adapted to rotate about a pivot axis 185 that is parallel to the longitudinal axis 173.

During assembly of the switch assembly 100 and installation to a cooking appliance 190, the first support member 120 and the second support member 150 are attached to a respective one of the plurality of gas valve 114, preferably at opposing ends of the manifold of the serially arranged gas valves 114. Each one of the first and second support member 120, 150 is slid over the stem 115 of the gas valve 114 and positioned so that respective first and second mounting portion 121, 151 face towards the gas supply pipe 117. It is understood by the person skilled in the art that the first and second support member 120, 150 may be attached to any one of the plurality of gas valves 114, so as to provide a base for the actuating member 170 and the ignition switch 135. Further still, in the event of a single gas valve 114, only the first support member 120 may be used for the switch assembly 100.

The electric ignition switch 135 may be provided already installed with the first support member 120. Alternatively, the electric switch 135 is positioned into the switch bracket 130 with the spring biased actuator 137 facing upwards towards the valve control knob 119.

The apertures 174*a-f* of the actuating member 170 are now moved over respective stems 115 of the plurality of gas valves 114 and the projecting flange 180 is operably coupled to the clip mechanism of respective first and second support arm 140, 160 (i.e. the flange 180 is clipped into engagement with respective first and second receiving elements 142, 162 and first and second locking elements 144, 164). The rounded end 182 of the flange 180 provides the pivot point about which the actuating member 170 moves during engagement. When in position, the front end (opposite the flange 182) of the plate 172 is supported by the spring biased actuator 137. The biasing force provided by the spring biased actuator 137 is greater than the force provided by the weight of the plate 172, so that an additional force is required to move the spring biased actuator 137 from its first position (switch OFF) to its second position (switch ON).

The plate 172 of the actuating member 170 may be provided with a series of recesses 178 along the long front edge (opposite the flange 180) of the plate 172. The recesses 178 may ensure access to each one of the plurality of gas valves 114 after the plate 172 is installed (e.g. for maintenance, or for calibration, for example by using a screw driver to adjust the gas valve).

After mounting the actuating member 170 to respective first and second support member 120, 150, valve control knobs 119 are attached to end portions of the stem 115 of the gas valves 114. Each one of the valve control knobs 119 is configured to operably engage with the actuating member 170 when opening respective gas valve 114, i.e. the valve control know 119 can be rotated to open and close the gas valve via stem 115 and also move axially (via stem 115) to push the actuating member 170 (pivot about rounded end portion 182) and spring biased actuator 137 from its first position towards and into the second position.

Figure 8A:
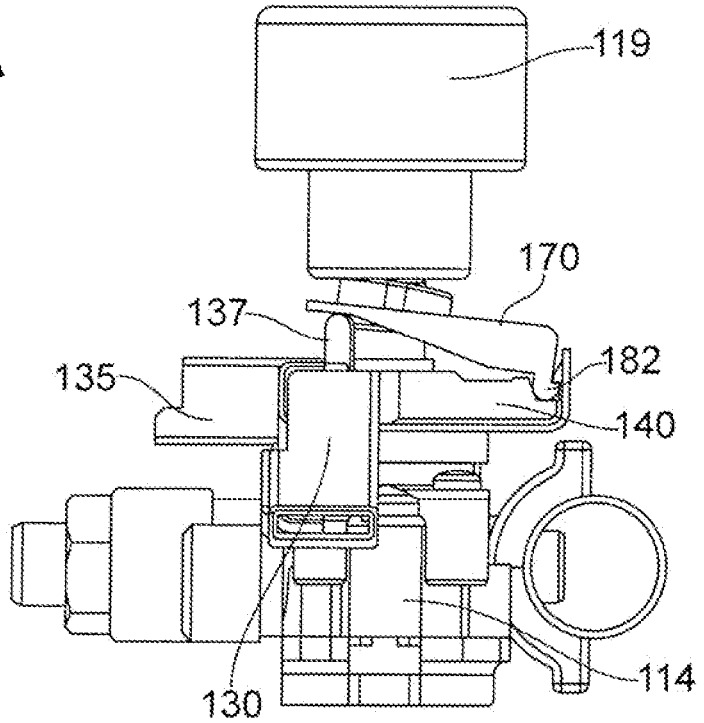
FIG. 8A shows a side view of the switch assembly of the present invention mounted to a cooking appliance with the valve control knob in its start position.
Figure 8B:
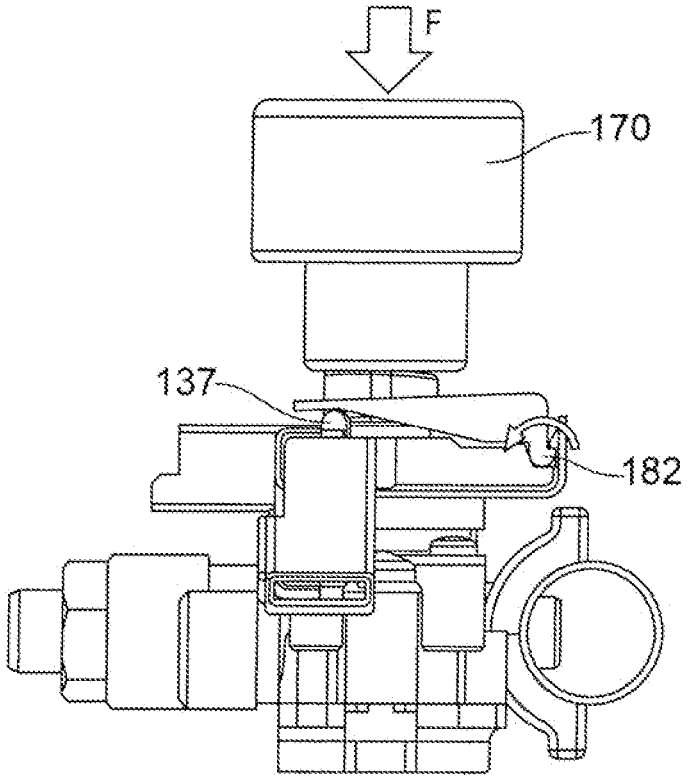
FIG. 8B shows a side view of the switch assembly of the present invention mounted to a cooking appliance with the valve control knob pushed down.

The function of the example embodiment of the switch assembly 100 of the present invention is now described with reference to FIGS. 8A and 8B, as well as, FIG. 9, which shows a schematic diagram of a cooking appliance 190 with the switch assembly 100 of the present invention. In particular, the schematic diagram of the cooking appliance 190 and switch assembly 100 shows the electric circuit diagram of the ignition circuit 196, ignition switch 135 and terminal board 199 operably coupled to the gas valve manifold (gas valves 114) and gas burners 192 via spark plugs 198. During use, i.e. the operation of one or more gas burners 192, the user simply operates the valve control knob 119 (e.g. push and rotate) to open the gas supply and actuate the ignition switch so as to ignite the gas burners 192 via spark plugs 198. In particular, the operation of the valve control knob 119 causes the actuating member 170 to engage with the spring biased actuator 137 and move the spring biased actuator 137 from its first position (OFF) into the second depressed position (ON). When the ignition switch 135 is closed (i.e. ON) and the gas supply is open, the respective gas burner 192 is ignited by a discharge of a respective spark plug 198. Once the gas burner 192 is ignited, the user releases the pushing pressure on gas control knob 119 which will be moved back into its first position by the biasing force of the spring biased actuator 137 (i.e. back into its OFF position). The user may repeat the operation for any other one of the gas burners 192. Each time one of the gas control knobs 119 is operated, the actuating member 170 will engage with the spring biased actuator 137 so as to move the spring biased actuator 137 between its first (OFF) and second (ON) position allowing each of the gas burners to be ignited via spark plugs 198.

In order to switch off any one or all of the gas burners 192, the user simply closes the gas supply via the respective gas control knob 119.

Figure 10A:
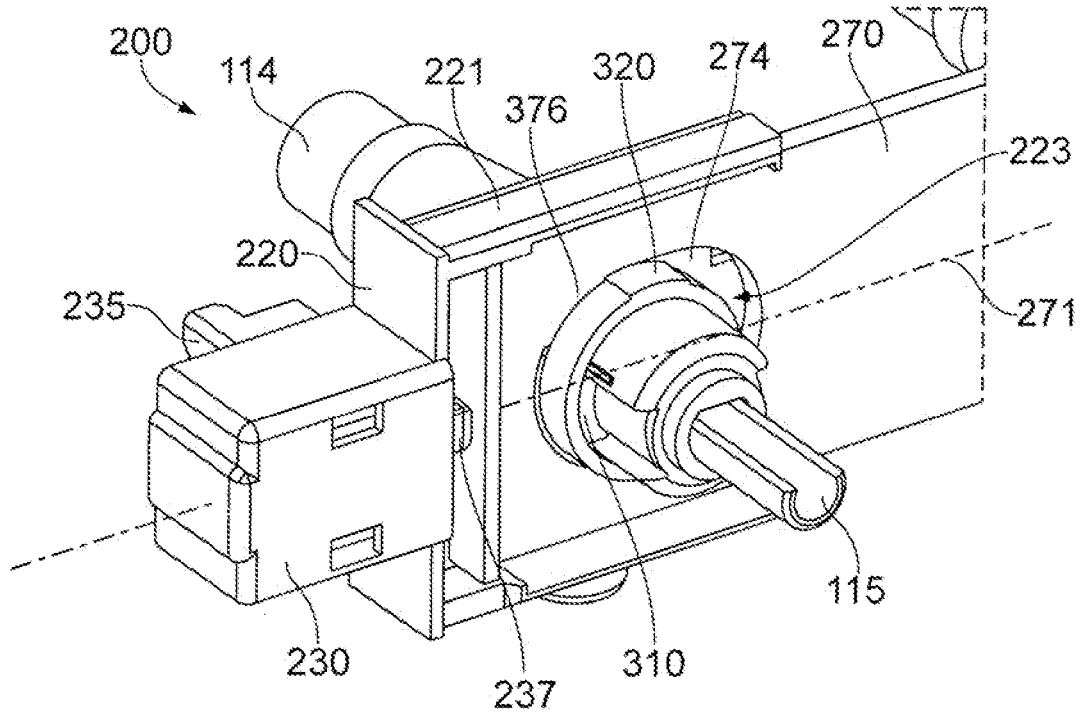
FIG. 10A shows a preferred alternative embodiment of the switch assembly of the present invention with the first support member and actuating member mounted to a gas valve of a cooking appliance in a perspective top-left view.
Figure 10B:
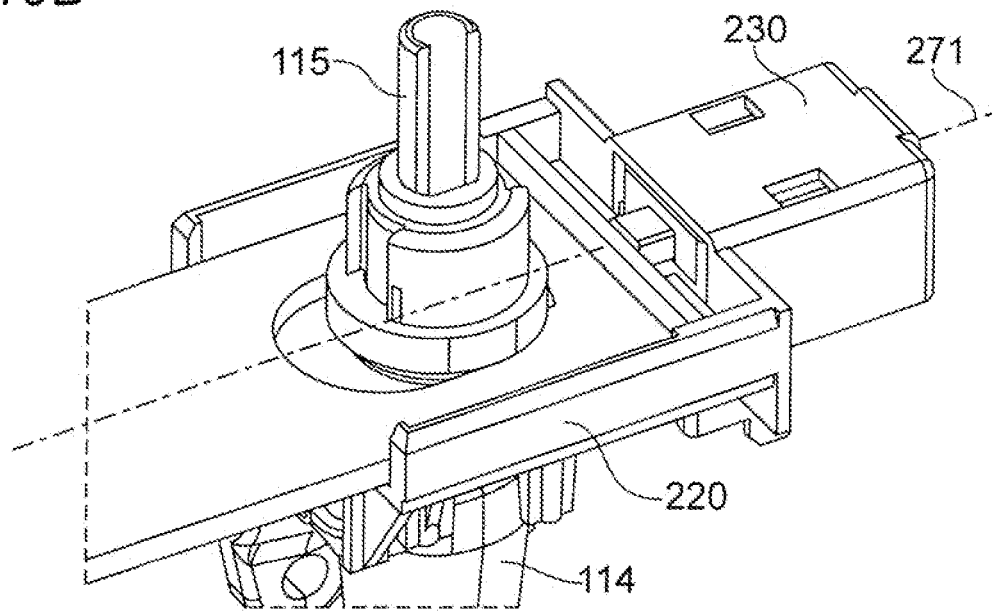
FIG. 10B shows a preferred alternative embodiment of the switch assembly of the present invention with the first support member and actuating member mounted to a gas valve of a cooking appliance in a perspective top-right view.
Figure 11A:
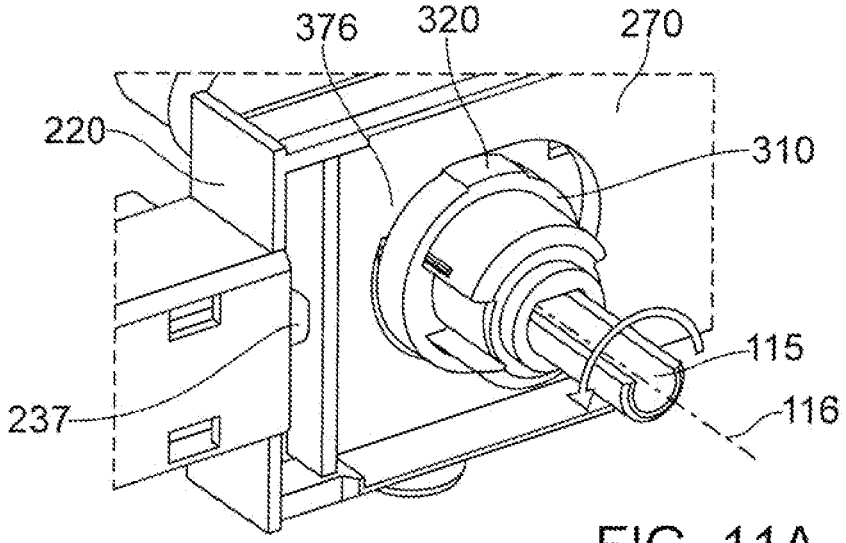
FIG. 11A shows a first position in a sequence A-C of the operation of the alternative switch assembly shown in FIG. 10, rotating the gas valve stem counter-clockwise so as to actuate the ignition switch via the cam mechanism.
Figure 11B:
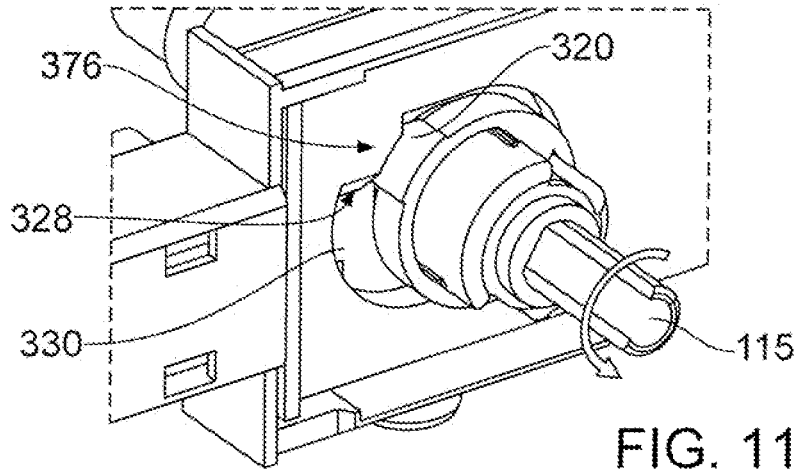
FIG. 11B shows a second position in the sequence A-C of the operation of the alternative switch assembly shown in FIG. 10, rotating the gas valve stem counter-clockwise so as to actuate the ignition switch via the cam mechanism.
Figure 11C:
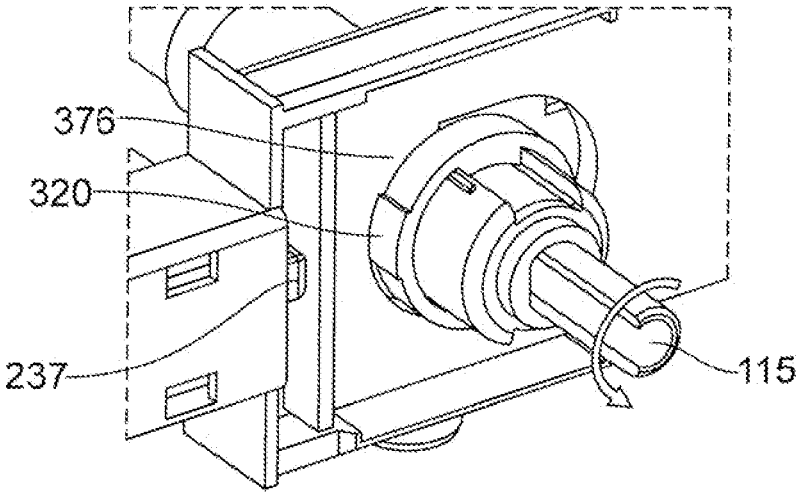
FIG. 11C shows a third position in the sequence A-C of the operation of the alternative switch assembly shown in FIG. 10, rotating the gas valve stem counter-clockwise so as to actuate the ignition switch via the cam mechanism.

Referring now to FIGS. 10, 11 and 12, a preferred alternative example embodiment of the switch assembly 200 of the present invention is described. This switch assembly 200 comprises, inter alia, a first support member 220 and a second support member (not shown), the first support member 220 comprising a switch bracket 230 arranged so as to operably and retainingly receive an ignition switch 135. The switch assembly 200 further comprises an actuating member 270 that is operably mounted to the plurality of gas valves 114 via the first 220 and second support member (not shown). Each one of the gas valves 114 is provided with a collar 310 configured to operably engage with the actuating member 270. In addition, the first support member 220 is configured to slidingly and retainingly receive an end portion of the actuating member 270.

The actuating member 270 comprises a plurality of apertures 223 arranged along the longitudinal center axis 271 of the actuating member 270 and spaced apart so as to be mountable over the stems 115 of the plurality of gas valves 114. Each one of the apertures 223 comprises a cam member 376 projecting radially inwards from the edge surface of the aperture 223. Furthermore, each one of the apertures 223 is of elongate shape along the longitudinal center axis 271, so as to allow axial movement of the actuating member 270 along the longitudinal center axis 271.

The switch bracket 230 is configured to retainingly receive an ignition switch 235 and is coupled to the first mounting portion 221 such that the spring biased actuator 237 is facing in a direction parallel to the longitudinal center axis 271 of the actuating member 270 and towards the actuating member 270, when assembled.

The collar 310 comprises a second cam member 320 projecting in a direction parallel to the center axis 116 of the gas valve stem 115 and which is adapted to operably engage with the first cam member 376 during rotation of the gas valve stem 115 (e.g. via a valve control knob (not shown)). In particular, first and second cam members 376, 320 form a cam mechanism configured to move the actuating member 270 towards and into engagement with the spring biased actuator 237, when rotated counter-clockwise, and to move the collar 310 axially along the center axis 116 of the stem 115 and out of engagement with the actuating member 270, so that the actuating member is moved back along its longitudinal center axis 271 into its starting position by the spring biased actuator 237, before the collar 310 and second cam member 320 are moved back into aperture 223 and into engagement with the first cam member 376.

The function of the alternative example embodiment of the switch assembly 200 of the present invention is now described with reference to FIG. 11A-11C and FIG. 12A-12D.

During operation, the user simply rotates the valve control knob (not shown) and stem 115 counter-clockwise which also rotates the attached collar 310 counter-clockwise. Through rotation of the collar 310, the second cam 320 member of the collar 310 engages with the first cam member 376 of the actuating member 270 so as to push the actuating member 270 linearly along its longitudinal central axis 271 towards and into engagement with the spring biased actuator 237. Further rotation of the valve control knob and stem 115 will eventually move the spring biased actuator 235 from its first position (switch is OFF) to its second position (switch is ON) and close the ignition circuit and produce an ignition spark to ignite the gas burner (as described with the switch assembly 100). Further rotation of the stem 115 allows the second cam member 320 to move circumferentially passed the first cam member 376 so that the actuating member 270 is pushed back towards its starting position by the spring biased actuator 237. In this position, the second cam member 320 is now on the other side of the first cam member 376.

The counter-clockwise rotation of the stem 115 simultaneously opens the gas supply and temporarily closes the electric igniter circuit 196 (switch ON) to produce an ignition spark to light the gas burner 192. Further counter-clockwise rotation of the stem 115 (and collar 310) moves the spring biased actuator 237 back towards its first position opening the electric igniter circuit 196 (switch OFF).

Figure 12A:
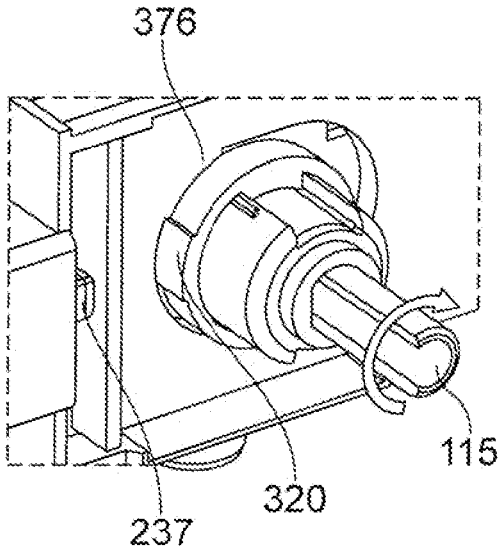
FIG. 12A shows a first position in a sequence A-D of the operation of the alternative switch assembly of FIG. 9, rotating the gas valve stem clockwise, so as to axially disengage from the cam mechanism.
Figure 12B:
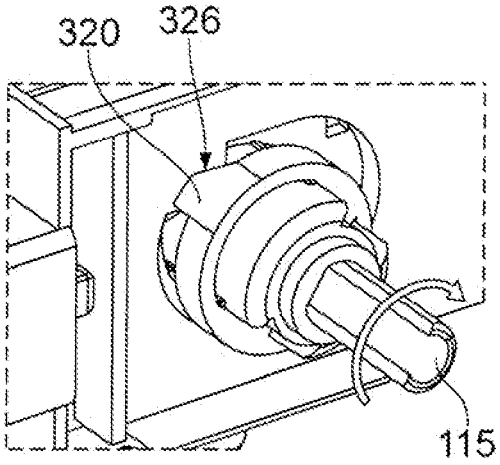
FIG. 12B shows a second position in the sequence A-D of the operation of the alternative switch assembly of FIG. 9, rotating the gas valve stem clockwise, so as to axially disengage from the cam mechanism.
Figure 12D:
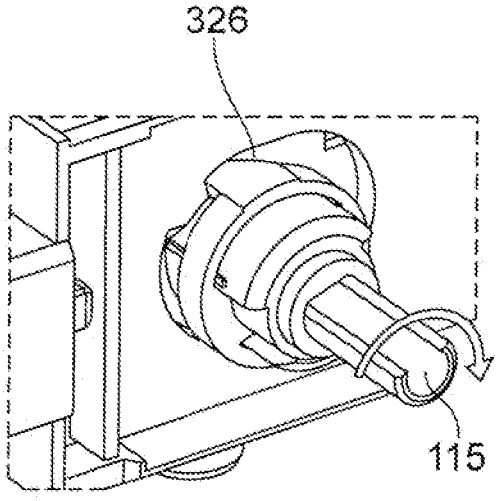
FIG. 12D shows a fourth position in the sequence A-D of the operation of the alternative switch assembly of FIG. 9, rotating the gas valve stem clockwise, so as to axially disengage from the cam mechanism.
Figure 12C:
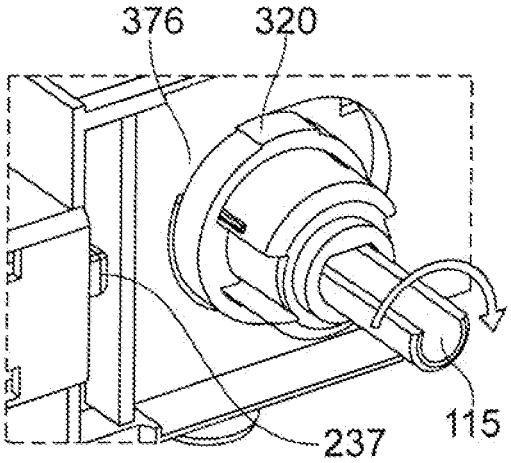
FIG. 12C shows a third position in the sequence A-D of the operation of the alternative switch assembly of FIG. 9, rotating the gas valve stem clockwise, so as to axially disengage from the cam mechanism.

In order to switch off the gas burner 192, the user simply rotates the valve control knob clockwise (FIG. 12A). Upon rotation of the stem 115, a chamfered side surface 326 of the second cam member 320 engages with a beveled side surface 328 of the first cam member 376, so as to move the collar 310 and second cam member 320 axially along the center axis of the stem 115 and out towards the valve control knob (FIG. 12B) and circumferentially passed and over the first cam member (FIG. 12C) until the second cam member 320 slots back into the aperture 223 and into its starting position (FIG. 12D).

Thus, the switch assembly 200 translates a rotational movement of the valve control knob into a linear movement of the actuating member 270 to engage the spring biased actuator 237 of the electric ignition switch 235. It is understood by the person skilled in the art that any suitable cam mechanism may be used to move the actuating member 270 between its first position (spring biased actuator 237 in OFF position) and its second position (spring biased actuator 237 in ON position.

While the aperture(s) 274*a-f* are described as an oval, the precise shape may vary. Thus, an actuating member 270 may have differently shaped apertures 274*a-f* in order to provide tolerance for series of gas valves 114 with different lengths and spacings. Further, the support members 120, 150, 220 and actuating members 170, 270 of the invention may be made from any suitable material. Preferred options may include appropriately rigid plastic material. However, other suitable materials may also include metals, alloys, or carbon-based materials or compounds.

Although specific examples of pivotable and linearly actuatable actuating members 170, 270 have been described, other types of movement or location may be provided within the scope of the claimed invention.

It will be appreciated by persons skilled in the art that the above embodiment(s) have been described by way of example only and not in any limitative sense, and that various alterations and modifications are possible without departing from the scope of the invention as defined by the appended claims.

What is claimed is:

1. A switch assembly for controlling the ignition of gas burners of a cooking appliance having one or more gas valves, comprising:

at least one first support member, operably couplable to a first gas valve;

a spring biased ignition switch, operably mountable to the at least one first support member;

an actuating member, having a longitudinal axis and operably couplable to at least the first gas valve between the at least one first support member and at least a control knob of at least the first gas valve, adapted to move between a first position, actuatingly engaged with the ignition switch, and a second position, actuatingly disengaged from the ignition switch, wherein the actuating member is moved towards the first position by at least the control knob, and back towards the second position by the spring biased ignition switch; and a cam mechanism adapted to operably engage, at a predetermined minimum angle of rotation and translation of the control knob, with at least one aperture of a plurality of apertures spaced apart along the longitudinal axis.

2. A switch assembly according to claim 1, wherein, when the cooking appliance has a plurality of serially arranged gas valves, the actuating member is operably couplable to all of the plurality of gas valves along the longitudinal axis.

3. A switch assembly according to claim 2, wherein the actuating member comprises the plurality of apertures, each aperture configured to operably engage with a respective one of the plurality of gas valves, during use.

4. A switch assembly according to claim 1, wherein the actuating member is operably couplable to at least the first gas valve via the cam mechanism adapted to convert a rotationally translational movement of the control knob of at least the first gas valve into a linear movement of the actuating member between the first position and the second position along the longitudinal axis.

5. A switch assembly according to claim 1, wherein the at least one first support member comprises a switch bracket configured to mountingly receive the spring biased ignition switch.

6. A switch assembly according to claim 1, wherein, when the cooking appliance has a plurality of serially arranged gas valves, the actuating member is movable towards the first position at least by the control knob of any one of the plurality of serially arranged gas valves.

7. A switch assembly according to claim 1, when the cooking appliance has a plurality of serially arranged gas valves, comprising at least one second support member operably couplable to a second gas valve.

8. A switch assembly according to claim 7, wherein the actuating member is movably coupled to the first and second support member.

9. A switch assembly according to claim 8, wherein each one of the first and second support member is adapted to slidingly retain a respective end portion of the actuating member.

10. A switch assembly according to claim 1, wherein the actuating member is pivotably coupled to at least the first support member and configured to rotatably move between the first position and the second position about a pivot axis that is parallel to the longitudinal axis.

11. A switch assembly according to claim 10, wherein the actuating member is pivotably coupled to the first support member and a second support member.

12. A cooking appliance comprising a switch assembly according to claim 1.

13. A switch assembly for controlling the ignition of gas burners of a cooking appliance having one or more gas valves, comprising:

at least one first support member, operably couplable to a first gas valve;

a spring biased ignition switch, operably mountable to the at least one first support member;

an actuating member, having a longitudinal axis and operably couplable to at least the first gas valve between the at least one first support member and at least a control knob of at least the first gas valve, adapted to move between a first position, actuatingly engaged with the ignition switch, and a second position, actuatingly disengaged from the ignition switch, wherein the actuating member is moved towards the first position by at least the control knob, and back towards the second position by the spring biased ignition switch;

wherein the actuating member is operably couplable to at least the first gas valve via a cam mechanism adapted to convert a rotationally translational movement of the control knob of at least the first gas valve into a linear movement of the actuating member between the first position and the second position along the longitudinal axis, and wherein the cam mechanism is adapted to operably engage with at least a first one of a plurality of apertures at a predetermined minimum angle of rotation and translation of the control knob.

14. A switch assembly for controlling the ignition of gas burners of a cooking appliance having one or more gas valves, comprising:

at least one first support member, operably couplable to a first gas valve;

a spring biased ignition switch, operably mountable to the at least one first support member;

an actuating member, having a longitudinal axis and operably couplable to at least the first gas valve between the at least one first support member and at least a control knob of at least the first gas valve, adapted to move between a first position, actuatingly engaged with the ignition switch, and a second position, actuatingly disengaged from the ignition switch, wherein the actuating member is moved towards the first position by at least the control knob, and back towards the second position by the spring biased ignition switch, wherein the cooking appliance has a plurality of serially arranged gas valves, comprising at least one second support member operably couplable to a second gas valve;

wherein the actuating member is movably coupled to the first and second support member, and wherein each one of the first and second support member is adapted to slidingly retain a respective end portion of the actuating member.

* * * * *